United States Patent [19]

Bludis et al.

[11] 4,022,682

[45] May 10, 1977

[54] HYDRODENITROGENATION OF SHALE OIL USING TWO CATALYSTS IN SERIES REACTORS

[75] Inventors: Joseph A. Bludis, Pittsburgh; David Lyzinski, Allison Park; Joel D. McKinney; Raynor T. Sebulsky, both of Pittsburgh; Harry C. Stauffer, Cheswick, all of Pa.

[73] Assignee: Gulf Research & Development Company, Pittsburgh, Pa.

[22] Filed: Dec. 22, 1975

[21] Appl. No.: 643,191

[52] U.S. Cl. ..... 208/89; 208/210; 208/254 H

[51] Int. Cl.[2] ..... C10G 34/00

[58] Field of Search ..... 208/254 H, 210, 89

[56] References Cited

UNITED STATES PATENTS

| | | | |
|---|---|---|---|
| 3,025,231 | 3/1962 | Friedman et al. | 208/210 |
| 3,094,480 | 6/1963 | Richardson | 208/89 |
| 3,227,646 | 1/1966 | Jacobson et al. | 208/254 H |
| 3,481,867 | 12/1969 | Dellert | 208/254 H |
| 3,717,571 | 2/1973 | Schulman | 208/254 H |
| 3,761,399 | 9/1973 | McKinney et al. | 208/210 |
| 3,817,855 | 6/1974 | Smith et al. | 208/254 H |

*Primary Examiner*—Delbert E. Gantz
*Assistant Examiner*—James W. Hellwege

[57] ABSTRACT

A process for hydrodenitrogenation of shale oil to convert it to a feed oil for zeolitic riser cracking comprising passing the shale oil through two catalyst stages in series, the catalyst in the first stage comprising supported molybdenum and Group VIII metal and the catalyst in the second stage comprising supported tungsten and Group VIII metal.

18 Claims, 1 Drawing Figure

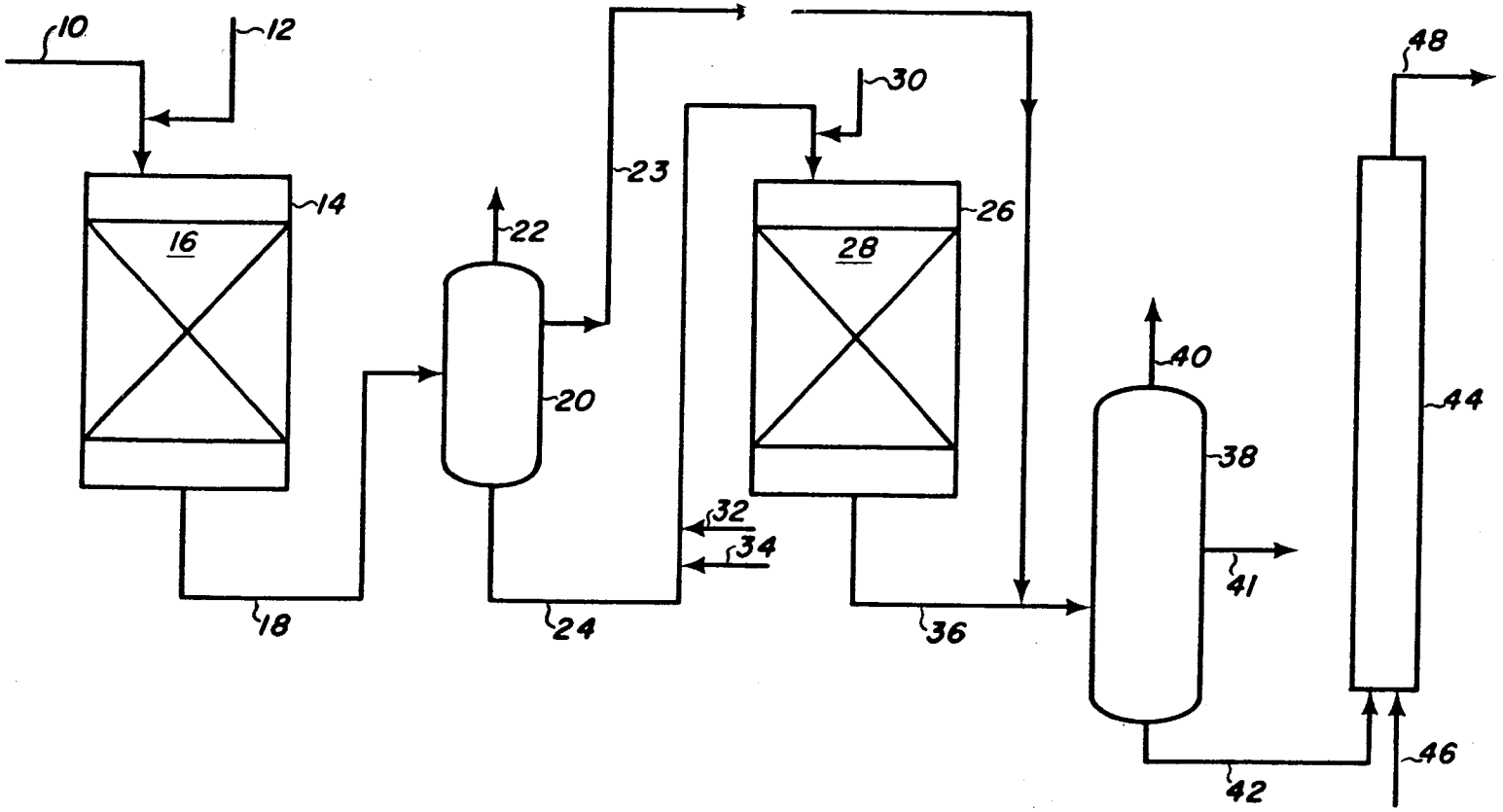
10
12
14
16
18
20
22
23
24
26
28
30
32
34
36
38
40
41
42
44
46
48

HYDRODENITROGENATION OF SHALE OIL USING TWO CATALYSTS IN SERIES REACTORS

This invention relates to a process for the hydrodenitrogenation of shale oil. More particularly, this invention relates to a process for the conversion of a raw shale oil into a feedstock for a zeolitic cracking riser.

In the preparation of shale oil for use as a feedstock for zeolite riser cracking it is necessary to reduce the nitrogen content of the shale oil to a low level in order to avoid an adverse effect of the nitrogen on the zeolitic cracking operation. In order for shale oil to be rendered suitable as a feedstock for conversion in high yield to naphtha in a zeolitic riser cracking operation, its nitrogen content must be reduced to about 3,000 ppm by weight, generally, or preferably to 2,000 ppm, or less. Processes for zeolitic riser cracking are well known. For example, see U.S. Pat. No. 3,617,512, which is hereby incorporated by reference.

The nitrogen content in shale oil is substantially higher than in petroleum oil and the nitrogen contained in shale oil is much more difficult to reduce to the low level required for converting the oil to a cracking feedstock without concurrent extensive hydrocracking. However, the occurrence of such hydrocracking in preparing a feedstock for a zeolitic cracking process defeats the objective of the hydrotreatment operation because the same cracking can be accomplished in the subsequent zeolitic cracking step in a much more economic manner because hydrogen is neither added to nor consumed in the subsequent zeolite cracking operation. Therefore, the present invention is directed towards a process for the preparation of a shale oil via hydrotreatment for subsequent zeolitic cracking in which the hydrotreatment occurs with improved selectivity towards nitrogen removal over hydrocracking.

Data presented below show that shale oil is unlike petroleum oil in a number of respects. For example, the sulfur content in shale oil tends to be relatively evenly distributed in all fractions and is relatively easily removed from all fractions, while in the case of petroleum oil the sulfur content is relatively more concentrated in the heavier fractions than in the lighter fractions and is more difficult to remove from the heavier fractions than from the lighter fractions. Data presented below show that in shale oil the nitrogen content is more heavily concentrated in the heavier fractions than in the lighter fractions. While the nitrogen content of petroleum oil can be reduced to a low level relatively easily via hydrotreatment, the high nitrogen content of shale oil is very difficult to reduce to a low level. The relatively severe temperature, pressure and space velocity conditions required for the reduction of the nitrogen content of shale oil to a low level generally induce significant hydrocracking.

While a boiling point reduction during hydrodenitrogenation of the shale oil fraction which boils in the residual oil range down to the gas oil boiling range will improve the characteristics of the shale oil as zeolite cracking feedstock, further reduction of the boiling range into the furnace oil or into the naphtha range or lower effectively defeats the objective of the zeolite cracking pretreatment. Any production of furnace oil or gasoline during the hydrotreatment is wasteful because it not only unnecessarily consumes hydrogen but it also tends to produce saturated naphtha constituents. Saturated naphtha usually exhibits a lower octane value than unsaturated naphtha. In contrast, the furnace oil and naphtha which is produced during zeolitic cracking is produced without hydrogen consumption and the naphtha which is produced tends to be olefinic and aromatic.

The present invention is directed towards a process for the hydrodenitrogenation of shale oil to produce an oil meeting nitrogen specifications of a zeolite cracker feedstock while preserving as much of the oil as possible in the furnace oil and heavier range, and preferably above the furnace oil boiling range. In accordance with the present invention, this objective is achieved by performing the hydrodenitrogenation process in at least two stages in series, employing a different catalyst in each of the two stages. Although the catalysts are different, each catalyst comprises Group VI-B metal and Group VIII metal or metals on a highly porous, non-cracking supporting material. Alumina is the preferred supporting material but other porous non-cracking supports can be employed.

In accordance with the present invention, the amount of Group VI-B metal and Group VIII metal or metals is generally different in each of the catalysts and a different Group VI-B metal is employed in each catalyst. In the first stage catalyst, the major Group VI-B metal is molybdenum and this is the supported metallic catalytic entity present in greatest amount on the catalyst. The catalyst contains a smaller amount of Group VIII metal than of molybdenum. In the second stage catalyst the major Group VI-B metal is tungsten instead of molybdenum. The tungsten can be, but is not necessarily, the supported catalytic entity present in greatest amount on this catalyst. The second stage catalyst can contain a larger amount of Group VIII metal than the catalyst of the first stage.

In the first stage catalyst, the molybdenum content can generally comprise about 1 to about 15 weight percent of the catalyst, or preferably can comprise about 5 to about 12 weight percent of the catalyst. One or more Group VIII metals can generally comprise about 1 to about 10 weight percent of the catalyst, or can preferably comprise about 1 to about 5 weight percent of the catalyst.

In the second stage catalyst, the tungsten content can generally comprise about 1 to about 25 weight percent of the catalyst, or preferably can comprise about 15 to about 22 weight percent of the catalyst. The Group VIII metal is advantageously nickel and can generally comprise about 1 to about 25 weight percent of the catalyst, or preferably can comprise about 3 to about 22 weight percent of the catalyst.

The above catalytic metal contents are the elemental metal content. However, the Group VI-B and Group VIII metal content of the hydrotreating catalyst of both stages will generally be present first as metal oxides and will be converted to the metal sulfide state before and/or during the hydrodenitrogenation operation.

Both stages of the hydrodenitrogenation process of this invention generally employ a hydrogen partial pressure of 500 to 5,000 pounds per square inch (35 to 350 kg/cm$^2$) and preferably employ a hydrogen pressure of 1,200 or 1,300 to 1,800 pounds per square inch (84 or 91 to 126 kg/cm$^2$). The hydrogen gas circulation rate in each stage can be generally between 1,000 and 10,000 standard cubic feet per barrel (17.8 and 178 SCM/100L), or preferably can be about 2,500 to 7,000 standard cubic feet per barrel (45 to 126 SCM/100L). The mol ratio of hydrogen to oil can be between about 4:1 and 80:1. Reactor temperatures in each stage can vary between about 650° and 800° F. (343° and 427° C.), generally, and between about 700° and 800° F. (371° and 427° C.), preferably. Reactor temperatures are gradually increased during a catalyst cycle to compensate for catalyst activity aging loss. The liquid hourly space velocity in each reactor can be generally between 0.1 and 5, and preferably between about 0.5 and 2.0 volumes of oil per hour per volume of catalyst. The hydrogen consumption in the tungsten catalyst stage will be between about 300 and 800 SCF/B (5.4 and 14.4 SCM/100L). The hydrogen consumption in the molybdenum catalyst stage will be greater, and generally will be at least 1.5 times greater.

In the high molybdenum catalyst stage of this invention, process severity should be sufficiently mild that not more than 20 weight percent of the feed oil to that stage boiling above the naphtha range is hydrocracked to material boiling within or below the naphtha range. Preferably, during the hydrotreatment not more than 5 or 10 weight percent of the feed oil to that stage boiling above 400° F. (204° C.) is converted to material boiling below 400° F. (204° C.). Any denitrogenation deficiency resulting from a low severity in the high molybdenum catalyst stage is compensated for in the high tungsten catalyst stage, which is more resistant to hydrocracking, even at higher process severities.

It is shown below that the tungsten catalyst exhibits a relatively high selectivity for hydrodenitrogenation over hydrocracking and that use of the tungsten catalyst permits removal of the most refractory nitrogen present in the shale oil with relatively little hydrocracking to naphtha boiling range material. Therefore, in the tungsten catalyst stage of this invention a higher process severity can be employed so that one or all of the following process conditions can be employed relative to the molybdenum catalyst stage; the liquid hourly space velocity can be lower, the hydrogen pressure can be higher and/or the temperature can be higher. In the tungsten catalyst stage specifically, even at these relatively severe hydrotreating conditions not more than 20 weight percent of the oil supplied to that stage which boils above the naphtha range is hydrocracked to material boiling within or below the naphtha range. Preferably, in the tungsten catalyst stage specifically, not more than 5 or 10 weight percent of the oil charged to that stage boiling above 400° F. (204° C.) is converted to material boiling below 400° F. (204° C.). Because of the high selectivity of the tungsten catalyst to denitrogenation over hydrocracking, the amount of naphtha or material boiling below 400° F. (204° C.) produced specifically in the tungsten catalyst stage will tend to be lower than that produced in the molybdenum catalyst stage, even when the molybdenum catalyst stage is operated under milder conditions of temperature, hydrogen pressure and/or space velocity.

In an advantageous embodiment of the present invention, not more than 20 weight percent, generally, or more than 5 or 10 weight percent, preferably, of the total feed oil to the plural-stage process, one stage employing the molybdenum catalyst and the other stage employing the tungsten catalyst, will be converted from oil boiling above 400° F. (204° C.) or 450° F. (232° C.) to oil boiling below these temperatures.

Table 1 shows the results of tests employing the molybdenum and tungsten catalysts of this invention for single stage hydrodenitrogenation of a full range shale oil.

Separate portions of the feed shale oil whose characteristics are shown in Table 1 were first mildly hydrotreated in an attempt to stabilize the oil before it was subjected to the two more severe hydrotreatment tests of Table 1. The mild hydrotreating conditions included temperatures of 500° and 525° F. (260° to 274° C.), total pressures of 560 and 750 psi (39 to 53 kg/cm²), space velocities of 1 and 2 v/v/hr, a gas circulation rate of about 2,500 SCF/B (45 SCM/100L), with unit hydrogen consumptions of 84 and 208 SCF/B (1.5 to 3.7 SCM/100L). The results of these mild hydrotreatments are not shown in Table 1 because these conditions were so mild that essentially no nitrogen was removed from the oil and the oil was not even stabilized against solids deposition upon standing. These tests showed that hydrotreating conditions of an order of mildness that would ordinarily be capable of stabilizing petroleum oil were not effective for stabilizing shale oil or for removing a significant amount of nitrogen therefrom.

The separate portions of the mildly hydrotreated feed shale oil were then hydrotreated under the more severe conditions shown in Table 1, under which substantial nitrogen removal was accomplished. One portion of the shale oil was hydrotreated with a catalyst comprising sulfided nickel, cobalt and molybdenum supported on alumina, comprising 1 weight percent nickel, 3 weight percent cobalt, and 12 weight percent molybdenum. The other catalyst comprised sulfided nickel and tungsten supported on alumina comprising 6 weight percent nickel and 19 weight percent tungsten. No fluorine compound was injected. The results of these tests are shown in Table 1.

TABLE 1

HYDROTREATMENT OF FULL RANGE SHALE OIL

| | | Product Inspections | |
|---|---|---|---|
| | Feed Shale Oil | 1% Ni, 3% Co, 12% Mo On Alumina Catalyst | 6% Ni – 19% W On Alumina Catalyst |
| Operating Conditions | | | |
| Temperature: ° F. (° C.) | — | 750(399) | 725(385) |
| Total Pressure: psig (kg/cm²) | — | 2173(152) | 2176(152) |
| LHSV: vol/hr/vol | — | 0.5 | 0.5 |
| Gas Circulation: SCF/B (SCM/100L) | — | 4260(76) | 10,000(178) |
| Hydrogen Consumption: SCF/B (SCM/100L) | — | 1218(21.7) | 1235(22) |
| Inspections ($C_5$+ Product) | | | |
| Gravity: ° API | 20.7 | 31.5 | 32.7 |
| Sulfur: Wt. % | 0.70 | — | <0.04 |
| Nitrogen: Wt. % | 1.99 | 0.33 | 0.4–0.5 |
| Bromine Number, D1159 | 54 | 5.9 | 5.5 |
| Carbon: Wt. % | 84.52 | 86.77 | 86.35 |
| Hydrogen: Wt. % | 11.14 | 12.84 | 12.94 |
| Oxygen: Wt. % (ppm) | 1.32 | 0.03 | (300) |
| Aniline Point, D611: ° F. | | 165 | 165 |
| Pour Point, D97: ° F. (° C.) | +75(+24) | +70(+21) | +80(+27) |
| Ash: Wt. % | 0.2 | | |

TABLE 1-continued

| HYDROTREATMENT OF FULL RANGE SHALE OIL | | Product Inspections | |
|---|---|---|---|
| | Feed Shale Oil | 1% Ni, 3% Co, 12% Mo On Alumina Catalyst | 6% Ni – 19% W On Alumina Catalyst |
| Naphtha (IBP-375° F.) (IBP-191° C.) | | | |
| Yield: Vol. % Total Liquid Product | 9.74 | 16.7 | 12.2 |
| Gravity: °API | 49.2 | 53.7 | 54.3 |
| Sulfur: Wt % (ppm) | 0.79 | (650) | (120) |
| Nitrogen: Wt. % | 0.44 | 0.05 | 0.081 |
| Denitrogenation: Wt. % | — | 89 | 82 |
| Bromine Number D1159 | | 8.2 | 0.4 |
| HC Type, ASTM D2789: Vol. % | | | |
| Paraffins | 33.9 | 51.0 | 52.6 |
| Naphthenes | 50.9 | 39.9 | 38.3 |
| Aromatics | 15.2 | 8.6 | 9.1 |
| Distillation, ASTM D86 | | | |
| Over Point: ° F. (° C.) | — | 214(101) | 207(97) |
| End Point: ° F. (° C.) | — | 358(181) | 370(188) |
| 10% Condensed at: ° F. (° C.) | — | 253(123) | 257(125) |
| 30 | — | 275(135) | 280(138) |
| 50 | — | 291(144) | 300(149) |
| 70 | — | 309(154) | 318(159) |
| 90 | — | 333(167) | 340(171) |
| Furnace Oil (375–680° F.) (191–360° C.) | | | |
| Yield: Vol. % Total Liquid Product | 30.85 | 43.7 | 45.0 |
| Gravity: °API | 29.3 | 36.0 | 35.3 |
| Sulfur: Wt. % | 0.63 | 0.05 | 0.054 |
| Nitrogen: Wt. % | 1.47 | 0.23 | 0.48 |
| Denitrogenation: Wt. % | — | 84 | 67 |
| Viscosity, SUS/100° F. (38° C.): Sec. | 40.1 | 36.5 | 37.9 |
| Pour Point, D97: ° F. | +15 | +10 | +10 |
| Bromine Number, D1159: | — | 3.7 | 4.1 |
| Aniline Point, D611: ° F. (° C.) | 87.1(31) | 149(65) | 145(63) |
| Carbon Residue, Rams, D524: Wt. % | — | 0.07 | 0.08 |
| Distillation, ASTM D86 | | | |
| 10% Condensed at: ° F. (° C.) | 446(230) | 441(227) | 451(233) |
| 30 | 492(256) | 475(246) | 486(252) |
| 50 | 538(281) | 514(268) | 529(276) |
| 70 | 580(304) | 559(293) | 574(301) |
| 90 | 626(330) | 613(323) | 617(325) |
| Gas Oil (680–960° F.) (360–516° C.) | | | |
| Yield: Vol. % Total Liquid Product | 32.57 | 24.3 | 32.0 |
| Gravity: °API | 16.3 | 27.2 | 25.7 |
| Sulfur: Wt. % | 0.60 | <0.04 | <0.04 |
| Nitrogen: Wt. % | 2.09 | 0.43 | 0.58 |
| Denitrogenation: Wt. % | — | 79 | 72 |
| Viscosity, SUS/100° F. (38° C.): Sec. | — | 152.7 | 246 |
| Viscosity, SUS/210° F. (99° C.): Sec. | 66.4 | 42.8 | 47.7 |
| Pour Point, D97: ° F. (° C.) | +100(+38) | +95(+35) | +100(+38) |
| Aniline Point, D611: ° F. (° C.) | 126(52) | — | 186.1 |
| Carbon Residue, Rams. D524: Wt. % | 0.91 | 0.08 | 0.09 |
| Distillation, ASTM D1160 | | | |
| 10% Condensed at: ° F. (° C.) | 749(398) | 714(379) | 744(396) |
| 30 | 786(419) | 743(395) | 770(410) |
| 50 | 827(442) | 774(412) | 802(428) |
| 70 | 866(463) | 808(431) | 840(449) |
| 90 | 992(494) | 857(460) | 892(478) |
| Residuum (960° F.+) (516° C.+) | | | |
| Yield: Vol. % Total Liquid Product | 26.84 | 15.3 | 10.8 |
| Gravity: °API | 5.9 | 22.4 | 23.5 |
| Sulfur: Wt. % | 0.64 | 0.09 | 0.12 |
| Nitrogen: Wt. % | 2.84 | 0.68 | 0.79 |
| Denitrogenation: Wt. % | — | 76 | 72 |
| Viscosity, SUS/210° F. (99° C.): Sec. | 5100 | 91.9 | — |
| Viscosity, SUS/250° F. (121° C.): Sec. | 1159 | 59.7 | 71.0 |
| Pour Point, D97: ° F. (° C.) | — | +115(+46) | +115(+46) |
| Ash: Wt. % | 0.64 | 0.02 | 0.02 |
| Carbon Residue, Con.: Wt. % | 20.3 | 2.82 | 1.85 |

The data of Table 1 show that the NiCoMo on alumina catalyst is generally superior for purposes of denitrogenation and pour point reduction as compared to the NiW on alumina catalyst. The data for the two catalysts are comparable in hydrogen consumption even though a higher temperature was utilized with the NiCoMo catalyst test. Table 1 shows both tests consumed about the same amount of hydrogen, 1,218 and 1,235 SCF/B (21.7 and 22 SCM/100L), respectively. Hydrogen economy is an important parameter for commercial purposes. The NiCoMo catalyst produced a combined $C_5$+ product having a nitrogen content of 0.33 weight percent, while the NiW catalyst produced a combined $C_5$+ product having a higher nitrogen content of 0.4–0.5 weight percent. For the test employing the NiCoMo catalyst, the product naphtha, furnace oil, gas oil and residuum fractions experienced percentage denitrogenations of 89, 84, 79 and 76, respectively, while the percentage denitrogenations for the same fractions employing the NiW catalyst were 82, 67, 72 and 72, respectively. These data show that for the lighter fractions, including naphtha and furnace oil, the denitrogenation activity of the NiCoMo catalyst is considerably superior to that of the NiW catalyst. However, for the gas oil fraction the denitrogenation activity for the NiCoMo catalyst has declined from its high level towards that of the NiW catalyst while for the residuum fraction the hydrodenitrogenation activities of the two catalysts are relatively close.

While the data of Table 1 show that when considering the combined product the NiCoMo catalyst has an overall superiority for denitrogenation at a comparable hydrogen consumption level as compared to the NiW catalyst, the data of Table 1 also show that the NiCoMo catalyst exerts its superior denitrogenation activity while incurring the severe disadvantage of concomitantly producing a relatively high naphtha yield. As shown in Table 1, the naphtha yield with the NiCoMo catalyst is 16.7 percent, while the naphtha yield with the NiW catalyst is only 12.2 percent. As explained above, when preparing a zeolite cracker feedstock via hydrotreatment not only is any naphtha produced wasteful of hydrogen but also the naphtha produced represents a lower octane value gasoline than naphtha which is produced in the subsequent zeolitic cracking operation which occurs without adding or consuming hydrogen. Moreover, the naphtha produced in the hydrotreating step must be further hydrotreated before it can be reformed. Table 1 therefore indicates that concomitant production of naphtha imposes a limitation in process severity when hydrotreating shale oil with the high molybdenum catalyst, whereas a similar problem is not apparent with the NiW catalyst.

Table 2 shows data obtained during first stage hydrotreatment of a shale gas oil employing a catalyst comprising sulfided 1 weight percent nickel, 3 weight percent cobalt and 12 weight percent molybdenum on alumina. The shale gas oil was passed over the catalyst at 1.0 LHSV, a total pressure of 1,700 psi (119 kg/cm$^2$), 4,000 SCF/B (72 SCM/100L), and a temperature of 725° F. (385° C.). The hydrogen consumption was about 1,100 SCF/B (19.8 SCM/100L).

TABLE 2

FIRST-STAGE HYDROTREATMENT OF SHALE GAS OIL WITH NiCoMo ON ALUMINA CATALYST

| | Feed Shale Gas Oil | First Stage Product |
|---|---|---|
| Gravity: °API | 13.9 | 26.8 |
| Sulfur: Wt. % | 0.49 | <0.04 |
| Nitrogen: Wt. % | 2.41 | 0.73 |
| Hydrogen: Wt. % | 10.85 | 12.26 |
| Oxygen: ppm | 0.80 | <100 |
| Viscosity, SUS, D2161: ° F/° C | | |
| 100/38 | — | 106.7 |
| 210/99 | 118.4 | 39.3 |
| Pour Point, D97: ° C (° F) | 41(105) | 32(90) |
| Aniline Point, D611: ° C (° F) | 38(101) | 73.5(164.3) |
| Carbon Residue, (R), D524: Wt. % | 1.34 | 0.12 |
| Distillation, Vac, D1160: ° C/° F | | |
| End Point | 556/1030 | 516/960 |
| 5% | 403/757 | 251/483 |
| 10% | 429/805 | 300/572 |
| 20% | 452/843 | 356/673 |
| 30% | 465/869 | 379/714 |
| 40% | 476/888 | 393/740 |
| 50% | 485/905 | 407/765 |
| 60% | 493/920 | 423/793 |
| 70% | 504/939 | 438/820 |
| 80% | 515/959 | 454/850 |
| 90% | 532/989 | 477/891 |
| 95% | 549/1021 | 498/928 |

Referring to Table 2, it is seen that the NiCoMo catalyst easily accomplished nearly complete removal of the sulfur content of the feed shale gas oil and accomplished reduction of the nitrogen content from 2.41 to 0.73 weight percent. However, the data of Table 2 show that this level of denitrogenation induced considerable hydrocracking in that about 50 percent of the effluent from the hydrotreatment boiled below the 5 percent distillation point of the feed oil. Moreover, the 5 percent distillation point in the effluent stream was close to the naphtha range.

Table 3 shows the results of two hydrotreating tests wherein the shale gas oil effluent from the first-stage test of Table 2 was passed over a NiW on alumina catalyst comprising 20 weight percent each of nickel and tungsten at a 0.75 LHSV, a temperature of about 738° F. (392° C.) and a total pressure of 1,750 psi (123 kg/cm$^2$). The hydrogen consumption was about 525 SCF/B (37 SCM/100L). Before being passed to the second stage, the first stage effluent was flashed to remove contaminant gases, such as hydrogen sulfide, ammonia and light hydrocarbons, and fresh hydrogen was added to the feed to the second stage. The removal of these materials has the effect of increasing hydrogen partial pressure and reducing space velocity in the second stage. Because of the low sulfur content of the oil, in order to maintain the second stage catalyst in the sulfided state and to maintain the activity of the alumina support of the second stage catalyst, the feed to the second stage was spiked with a hydrogen sulfide precursor in the form of $CS_2$ and with a fluorine precursor in the form of ortho-fluoro-toluene.

TABLE 3

SECOND-STAGE HYDROTREATMENT OF SHALE GAS OIL WITH NiW ON ALUMINA CATALYST

| | First Stage Product | Second Stage Product | Second Stage Product |
|---|---|---|---|
| Gravity: °API | 26.8 | 29.7 | 31.2 |
| Sulfur: Wt. % | <0.04* | — | — |
| Nitrogen: Wt. % | 0.73 | 0.28 | 0.10 |
| Hydrogen: Wt. % | 12.26 | 13.00 | 13.18 |
| Oxygen: ppm | <100 | <100 | <100 |
| Viscosity, SUS, D2161: ° F/° C | | | |
| 100/38 | 106.7 | 83 | 65.8 |
| 210/99 | 39.3 | 37.7 | 35.8 |
| Pour Point, D97: ° C (° F) | 32(+90) | 27(+80) | 29(+85) |
| Aniline Point, D611: ° C (° F) | 73.5(164.3) | 83.3(181.9) | 85.6(186.1) |
| Carbon Residue, (R), D524: Wt. % | 0.12 | 0.07 | 0.05 |
| Distillation, Vac, D1160: ° C/° F | | | |
| End Point | 516/960 | 513/956 | 508/947 |
| 5% | 251/483 | 234/453 | 217/422 |
| 10% | 300/572 | 269/517 | 251/484 |
| 20% | 356/673 | 333/632 | 310/590 |
| 30% | 379/714 | 364/688 | 349/661 |
| 40% | 393/740 | 386/727 | 374/705 |
| 50% | 407/765 | 415/779 | 406/763 |
| 60% | 423/793 | 432/809 | 422/791 |
| 70% | 438/820 | 451/843 | 442/827 |

TABLE 3-continued

SECOND-STAGE HYDROTREATMENT OF SHALE GAS OIL WITH NiW ON ALUMINA CATALYST

| | First Stage Product | Second Stage Product | Second Stage Product |
|---|---|---|---|
| 80% | 454/850 | 472/882 | 453/848 |
| 90% | 477/891 | 478/893 | 466/870 |
| 95% | 498/928 | 491/915 | 492/918 |

*This material was spiked with 2,000 ppm sulfur as $CS_2$ and 4 ppm fluorine as ortho-fluoro-toluene.

The data of Table 3 show that in the two NiW on alumina second stage tests employing the shale gas oil effluent stream from the NiCoMo on alumina first stage test of Table 2, the nitrogen content was reduced to 2,800 ppm and 1,000 ppm, respectively, and these low nitrogen levels were achieved with very little further reduction in the boiling range of the stream. It is noted that the sharply inhibited hydrocracking which was exhibited by the second stage occurred in spite of the fact that the second stage operated at a higher temperature, a higher pressure and a lower space velocity than the first stage.

The data of Tables 2 and 3 show that the total product denitrogenation superiority of the NiCoMo catalyst and the reduced hydrocracking characteristic of the NiW catalyst as demonstrated in the data of Table 1 can function interdependently in a multi-stage process of the present invention wherein the NiCoMo catalyst is employed in a first series stage and the NiW catalyst is employed in a second series stage. Since the most refractory nitrogen is removed in the presence of the NiW catalyst, which is resistant to hydrocracking, the second stage can operate under one or more conditions which are relatively more severe than the corresponding condition employed in the first stage.

Table 4 shows the results of further tests illustrating second stage hydrotreatment of the oil treated in the tests of Table 3 using a NiW catalyst at various process severities. In these tests the temperatures and space velocities were varied.

TABLE 4

SECOND-STAGE HYDROTREATMENT OF SHALE GAS OIL WITH NiW ON ALUMINA CATALYST

| | | | | | | | |
|---|---|---|---|---|---|---|---|
| Feed: Effluent from NiCoMo on alumina first stage | | | | | | | |
| °API | 26.8 | | | | | | |
| Nitrogen: Wt. % | 0.73 | | | | | | |
| Operating Conditions: | | | | | | | |
| Total Reactor Pressure | 1,750 psi (123 kg/cm²) | | | | | | |
| Recycle Gas Rate | 8,450 SCF/B (152 SCM/100L) | | | | | | |
| Makeup Hydrogen | 85 volume percent | | | | | | |
| Recycle Gas Hydrogen | 80 volume percent | | | | | | |
| LHSV: | 1.0 | 1.0 | 1.0 | 0.5 | 0.75 | 0.75 | 1.0 |
| Catalyst Temperature: ° C. | 382 | 390 | 402 | 402 | 402 | 392 | 402 |
| ° F. | 720 | 734 | 755 | 755 | 755 | 738 | 755 |
| Product Nitrogen: Wt. % | 0.28 | 0.24 | 0.17 | 0.05 | 0.13 | 0.19 | 0.17 |

The data of Table 4 show that a wide range of product nitrogen levels can be recovered from a second stage employing a NiW on alumina second stage catalyst, depending on process severity. All the product nitrogen levels of these tests meet zeolitic cracker feed oil specifications.

A process scheme for carrying out the present invention is illustrated in the accompanying FIGURE.

As shown in the accompanying FIGURE, feed shale oil passed through line 10 and hydrogen passed through line 12 flow downwardly through a fixed bed of NiCoMo on alumina catalyst 16 disposed in reactor 14. An effluent stream leaving reactor 14 in line 18 passes to a distillation zone 20 from which hydrogen sulfide, ammonia and some light hydrocarbons are removed overhead through line 22, and a relatively high nitrogen content residue fraction is removed through line 24. If desired, a relatively low nitrogen content middle oil can be cut from the residue and removed through line 23.

The stream in line 24 is passed downwardly through a fixed bed 28 of NiW on alumina catalyst disposed in reactor 26. Hydrogen is charged through line 30, carbon disulfide is charged through line 32 and ortho-fluoro-toluene is charged through line 34 and these all flow downwardly through reactor 26. An effluent stream is removed from reactor 26 through line 36.

The low nitrogen middle oil in line 23 either can be removed from the process or can be blended with the oil in line 36 and the blend is charged to distillation zone 38, from which light gases are removed through line 40, while naphtha and possibly some furnace oil is removed through line 41. Distillation residue boiling above the naphtha range meeting zeolitic cracker nitrogen specifications is removed through line 42, at least a portion of which is passed together with hot regenerated zeolite catalyst entering through line 46 upwardly through riser 44. The residence time in riser 44 is less than 5 seconds. Effluent comprising naphtha and furnace oil together with zeolite catalyst is removed overhead through line 48.

We claim:

1. A process for hydrodenitrogenation of shale oil comprising passing feed shale oil and hydrogen through a zone containing a sulfided first catalyst comprising molybdenum as the major supported metallic component in an amount between about 1 and 15 weight percent together with between about 1 and 10 weight percent of Group VIII metal on a non-cracking support, removing an effluent oil from the first catalyst zone, removing hydrogen sulfide and ammonia from the effluent oil from the first catalyst zone, in said first zone not more than 20 weight percent of said feed oil boiling above the naphtha range is converted to oil boiling in or below the naphtha range, passing the effluent oil from the first catalyst zone and hydrogen through a zone containing a sulfided second catalyst comprising tungsten in an amount between about 1 and 25 weight percent together with between about 1 and 25 weight percent of Group VIII metal on a non-cracking support, the temperature in said zones being between about 650° and 800° F., the hydrogen pressure in said zones being between about 500 and 5,000 psi, and the liquid hourly space velocity in said zones being between about 0.1 and 5.0, and removing an effluent stream from said second catalyst zone.

2. The process of claim 1 wherein said first catalyst comprises between about 5 and 12 weight percent molybdenum and between about 1 and 5 weight percent Group VIII metal.

3. The process of claim 1 wherein said second catalyst comprises between about 15 and 22 weight percent tungsten and between about 3 and 22 weight percent Group VIII metal.

4. The process of claim 1 wherein the first catalyst support comprises alumina.

5. The process of claim 1 wherein the second catalyst support comprises alumina.

6. The process of claim 1 wherein the first catalyst comprises sulfided cobalt and molybdenum on alumina and the second catalyst comprises sulfided nickel and tungsten on alumina and the oil and hydrogen are passed downwardly through fixed beds of said catalysts.

7. The process of claim 1 wherein the temperature in the zone containing said second catalyst is higher than in the zone containing said first catalyst.

8. The process of claim 1 wherein the hydrogen pressure in the zone containing said second catalyst is higher than in the zone containing said first catalyst.

9. The process of claim 1 wherein the liquid hourly space velocity in the zone containing said second catalyst is lower than in the zone containing said first catalyst.

10. The process of claim 1 wherein not more than 10 weight percent of the feed oil boiling above 400° F. is converted to oil boiling below 400° F.

11. The process of claim 1 wherein effluent oil boiling above the naphtha range from the zone containing the second catalyst has a nitrogen content below 3,000 ppm, at least a portion of which is passed to a zeolitic cracking zone.

12. The process of claim 1 wherein effluent oil from the zone containing the second catalyst boiling above the naphtha range has a nitrogen content below 2,000 ppm, at least a portion of which is passed to a zeolitic cracking zone.

13. The process of claim 1 wherein a hydrogen sulfide precursor compound is added to the zone containing said second catalyst.

14. The process of claim 1 wherein a fluorine precursor compound is added to the zone containing said second catalyst.

15. The process of claim 1 wherein the hydrogen consumption in the zone containing the second catalyst is between about 300 and 800 SCF/B and the hydrogen consumption in the zone containing the first catalyst stage is greater.

16. The process of claim 1 wherein the hydrogen consumption in the zone containing the second catalyst is between about 300 and 800 SCF/B and the hydrogen consumption in the zone containing the first catalyst is at least 1.5 times greater.

17. The process of claim 1 wherein the oil effluent from the first catalyst zone is distilled and the distillation residue fraction is passed to the second catalyst zone.

18. The process of claim 1 wherein the hydrogen pressure in said zones is between about 1,300 and 1,800 psi.

* * * * *